US011466871B2

(12) United States Patent
Teraoka

(10) Patent No.: US 11,466,871 B2
(45) Date of Patent: Oct. 11, 2022

(54) CROSS FLOW FAN BLADE, CROSS FLOW FAN, AND AIR CONDITIONER INDOOR UNIT

(71) Applicant: DAIKIN INDUSTRIES, LTD., Osaka (JP)

(72) Inventor: Hironobu Teraoka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/701,491

(22) Filed: Mar. 22, 2022

(65) Prior Publication Data

US 2022/0214052 A1 Jul. 7, 2022

Related U.S. Application Data

(63) Continuation of application No. PCT/JP2020/021573, filed on Jun. 1, 2020.

(30) Foreign Application Priority Data

Sep. 30, 2019 (JP) ..... JP2019-179027

(51) Int. Cl.
*F04D 29/28* (2006.01)
*F24F 1/0025* (2019.01)
(Continued)

(52) U.S. Cl.
CPC ..... *F24F 1/0025* (2013.01); *F04D 17/04* (2013.01); *F04D 29/30* (2013.01)

(58) Field of Classification Search
None
See application file for complete search history.

(56) References Cited

U.S. PATENT DOCUMENTS 7,422,418 B2 * 9/2008 Ishijima ..... F04D 17/04 416/243
8,011,891 B2 * 9/2011 Ochiai ..... F04D 29/282 416/243
(Continued)

FOREIGN PATENT DOCUMENTS

CN 105849417 A 8/2016
JP 2001-274486 A 10/2001
(Continued)

OTHER PUBLICATIONS

International Preliminary Report of corresponding PCT Application No. PCT/JP2020/021573 dated Apr. 14, 2022.
(Continued)

*Primary Examiner* — Ninh H. Nguyen
(74) *Attorney, Agent, or Firm* — Global IP Counselors, LLP

(57) ABSTRACT

A cross flow fan blade includes an inner edge disposed on an inner circumferential side of a cross flow fan, an outer edge disposed on an outer circumferential side of the cross flow fan, and a base part formed between the inner edge and the outer edge. The base part has a pressure face and a negative pressure face. A thickness of the inner edge is larger than 1.5 times a thickness of the outer edge. An interval between the pressure face and the negative pressure face in a direction perpendicular to the pressure face is a thickness of the base part. A maximum thickness position of the base part is closer to the inner edge than to the outer edge. When a blade chord length is L and a maximum thickness of the base part is tmax, tmax/L≤0.094, and a range of tmax/L≤0.08 is excluded.

14 Claims, 10 Drawing Sheets

(51) Int. Cl.
*F04D 17/04* (2006.01)
*F04D 29/30* (2006.01)

(56) References Cited

U.S. PATENT DOCUMENTS

| | | | | |
|---|---|---|---|---|
| 10,436,496 | B2 * | 10/2019 | Ikeda | F25D 17/06 |
| 2001/0033593 | A1 | 10/2001 | Minobe et al. | |
| 2017/0002827 | A1 | 1/2017 | Uda | |

FOREIGN PATENT DOCUMENTS

| | | | | |
|---|---|---|---|---|
| JP | 2014-34928 | A | 2/2014 | |
| JP | 2015-124766 | A | 7/2015 | |
| JP | 2018-84154 | A | 5/2018 | |
| WO | 2013/051297 | A1 | 4/2013 | |
| WO | WO-2018189931 | A1 * | 10/2018 | F04D 29/30 |
| WO | 2019/012578 | A1 | 1/2019 | |

OTHER PUBLICATIONS

International Search Report of corresponding PCT Application No. PCT/JP2020/021573 dated Aug. 4, 2020.

* cited by examiner

CROSS FLOW FAN BLADE, CROSS FLOW FAN, AND AIR CONDITIONER INDOOR UNIT

CROSS-REFERENCE TO RELATED APPLICATIONS

This is a continuation of International Application No. PCT/JP2020/021573 filed on Jun. 1, 2020, which claims priority to Japanese Patent Application No. 2019-179027, filed on Sep. 30, 2019. The entire disclosures of these applications are incorporated by reference herein.

BACKGROUND

Field of Invention

The present disclosure relates to a cross flow fan blade, a cross flow fan, and an air conditioner indoor unit.

Background Information

In, for example, air conditioner indoor units, in order to blow air; a cross flow fan is often used. In a cross-sectional shape of a cross flow fan blade, a pressure face and a negative pressure face on a side opposite to the pressure face are curved in a fan rotation direction toward an outer side of the blade from a fan rotary shaft. That is, the cross flow fan blade has a bow shape in which a central portion of the blade is disposed away from a straight line connecting an inner edge and an outer edge of the blade.

Japanese Unexamined Patent Application Publication No. 2015-124766 discloses a method of, in order to increase energy efficiency of a cross flow fan, reducing loss by suppressing separation of a flow at a negative pressure face as a result of setting a maximum thickness position of a blade closer to an inner edge than to an outer edge.

SUMMARY

A first aspect of the present disclosure is a cross flow fan blade including an inner edge disposed on an inner circumferential side of a cross flow fan, an outer edge disposed on an outer circumferential side of the cross flow fan, and a base part formed between the inner edge and the outer edge. The base part has a pressure face and a negative pressure face. A thickness of the inner edge is larger than 1.5 times a thickness of the outer edge. An interval between the pressure face and the negative pressure face in a direction perpendicular to the pressure face is a thickness of the base part. A maximum thickness position of the base part is closer to the inner edge than to the outer edge. When a blade chord length is L and a maximum thickness of the base part is tmax, $tmax/L \leq 0.094$, and a range of $tmax/L \leq 0.08$ is excluded.

DETAILED DESCRIPTION OF EMBODIMENT(S)

Embodiments of the present disclosure are described below with reference to the drawings. Note that the embodiments below are essentially preferred exemplifications, and are not intended to limit the present invention, objects applicable thereto, and the range of use thereof.

Embodiments

Structure of Air Conditioner Indoor Unit

Figure 1:
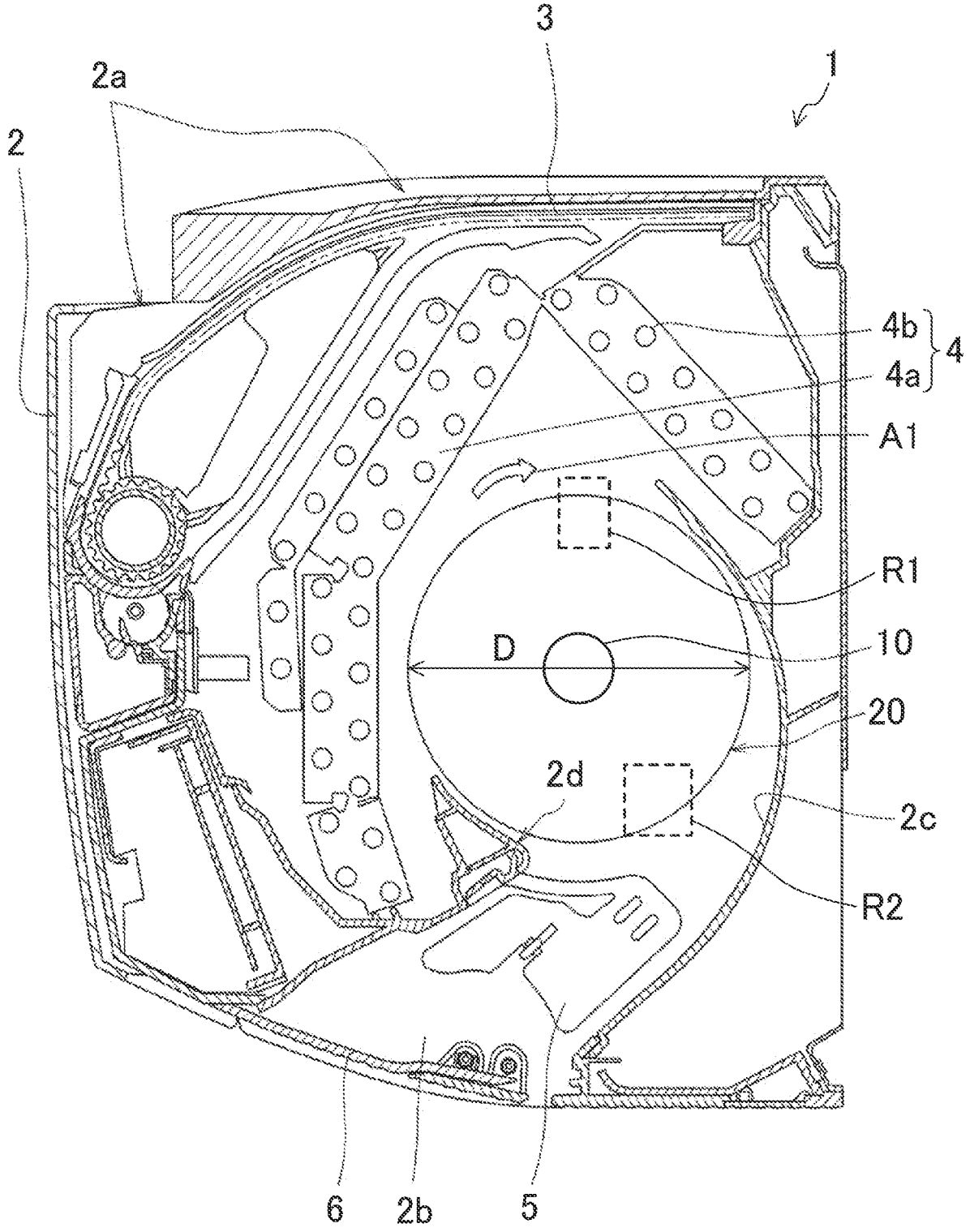
FIG. 1 is a sectional view of an air conditioner indoor unit according to an embodiment.

FIG. 1 is a sectional view of an air conditioner indoor unit (1) according to an embodiment. As shown in FIG. 1. the air conditioner indoor unit (1) primarily includes a body casing (2), an air filter (3), an indoor heat exchanger (4), a cross flow fan (10), a vertical flap (5), and a horizontal flap (6). Note that, in FIG. 1, "R1" and "R2" denote a suction region and a blow-out region of the cross flow fan (10), respectively.

A top surface of the body casing (2) has a suction port (2*a*). The air filter (3) facing the suction port (2*a*) is disposed on a downstream side of the suction port (2*a*). The indoor heat exchanger (4) is disposed further on a downstream side of the air filter (3). The indoor heat exchanger (4) is constituted by coupling a front-side heat exchanger (4*a*) and a rear-side heat exchanger (4*b*) so as to form an inverted V shape in side view. The front-side heat exchanger (4*a*) and the rear-side heat exchanger (4*b*) are each constituted by arranging a large number of plate fins side by side in parallel and mounting the plate fins on heat transfer tubes. Indoor air that passes through the suction port (2*a*) and that reaches the indoor heat exchanger (4) has dust therein removed when passing through the air filter (3). Heat is exchanged when indoor air that has been sucked from the suction port (2*a*) and that has passed through the air filter (3) passes through spaces between the plate fins of the front-side heat exchanger (4*a*) and the rear-side heat exchanger (4*b*).

The cross flow fan (10) having a substantially cylindrical shape and having a fan diameter D is provided on a downstream side of the indoor heat exchanger (4) so as to extend in a width direction of the air conditioner indoor unit (1) (direction perpendicular to the sheet plane of FIG. 1). The cross flow fan (10) is disposed parallel to the indoor heat exchanger (4). The cross flow fan (10) includes an impeller (20) that is disposed so as to be interposed between portions of the inverted V-shaped indoor heat exchanger (4), and a fan motor (not shown) for driving the impeller (20). The cross flow fan (10), as a result of rotating the impeller (20) in the direction of arrow A1 in FIG. 1 (clockwise), generates an airflow that is directed toward a blow-out port (2*b*) from the indoor heat exchanger (4). That is, the cross flow fan (10) is a transverse fan at which an airflow traverses the cross flow fan (10). The blow-out port (2*b*) is provided in a bottom surface of the body casing (2).

A rear side of a blow-out passage that communicates with the blow-out port (2*b*) situated downstream from the cross flow fan (10) is constituted by a scroll member (2*c*). A lower end of the scroll member (2*c*) is connected to a rear edge of the blow-out port (2*b*). In order to smoothly and quietly guide air that is blown out from the cross flow fan (10) to the blow-out port (2*b*), a guide surface of the scroll member (2*c*) has a smooth curved shape having a curvature center on a side of the cross flow fan (10) in sectional view. A tongue part (2*d*) is provided on a front side of the cross flow fan (10), and an upper side of the blow-out passage that continues from the tongue part (2*d*) is coupled to a front edge of the blow-out port (2*b*). The direction of an airflow that is blown out from the blow-out port (2*b*) is adjusted by the vertical flap (5) and the horizontal flap (6).

Structure of Cross Flow Fan

Figure 2:
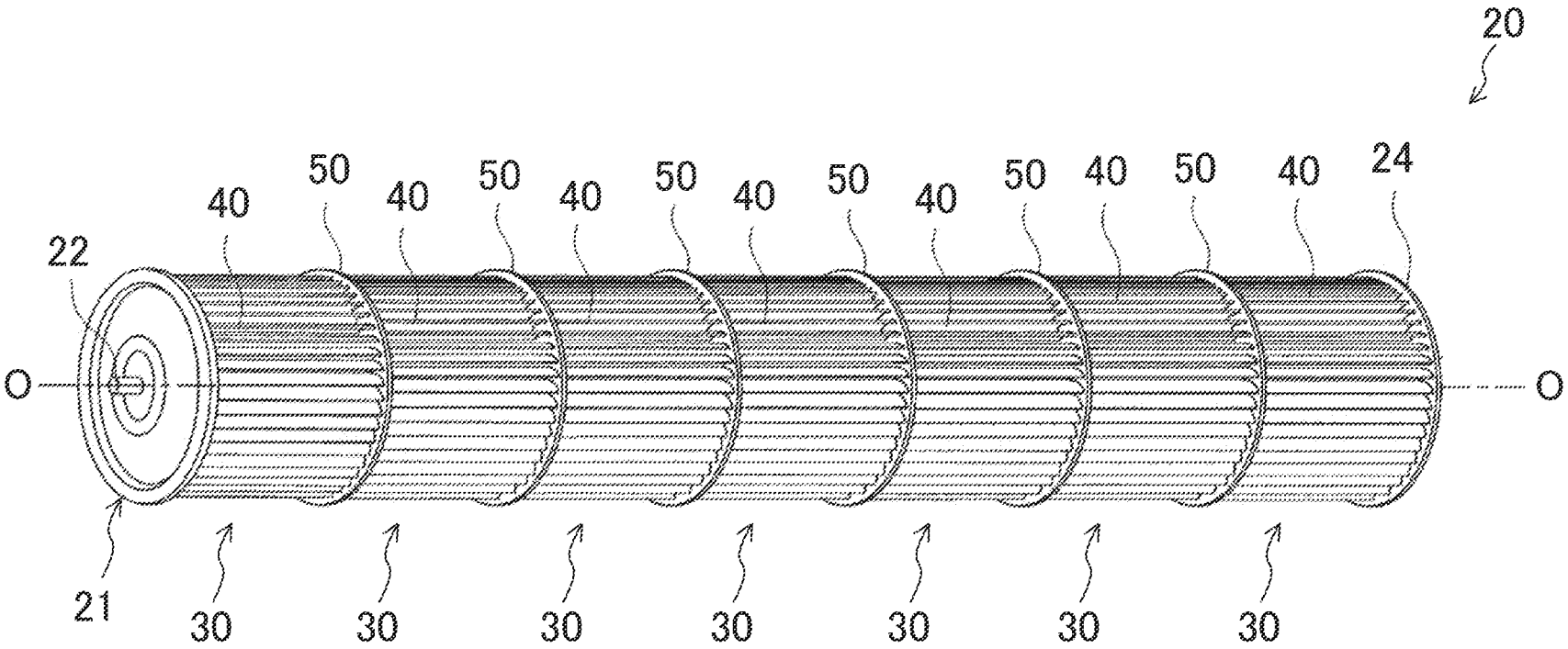
FIG. 2 is a perspective view of an impeller of a cross flow fan according to an embodiment.

FIG. 2 is a perspective view of the impeller (20) of the cross flow fan (10). As shown in FIG. 2, the impeller (20) has a structure in which a plurality of fan blocks (30) (for example, seven fan blocks (30)) are joined to each other in series, and two ends of the structure are provided with a corresponding one of end plates (21) and (24). The impeller (20) has a metallic rotary shaft (22) on an axis (O). An end portion of the rotary shaft (22) protrudes from the end plate (21) disposed at one end of the impeller (20), and the end portion is supported by the body casing (2). A motor (not shown) that drives the rotary shaft (22) is provided on a side of the end plate (24) disposed on the other end of the impeller (20).

Each fan block (30) includes a plurality of blades (40) and a ring-shaped supporting plate (50). The plurality of blades (40) are arranged around the rotary shaft (22) with the rotary shaft (22) being a center. Adjacent blades (40) are spaced apart from each other by a predetermined interval. Two ends of each blade (40) (two ends in a direction in which the rotary shaft (22) extends) are supported by two supporting plates (50), or by a supporting plate (50) and the end plate (21) or the end plate (24).

Structure of Blades of Cross Flow Fan

Figure 3:
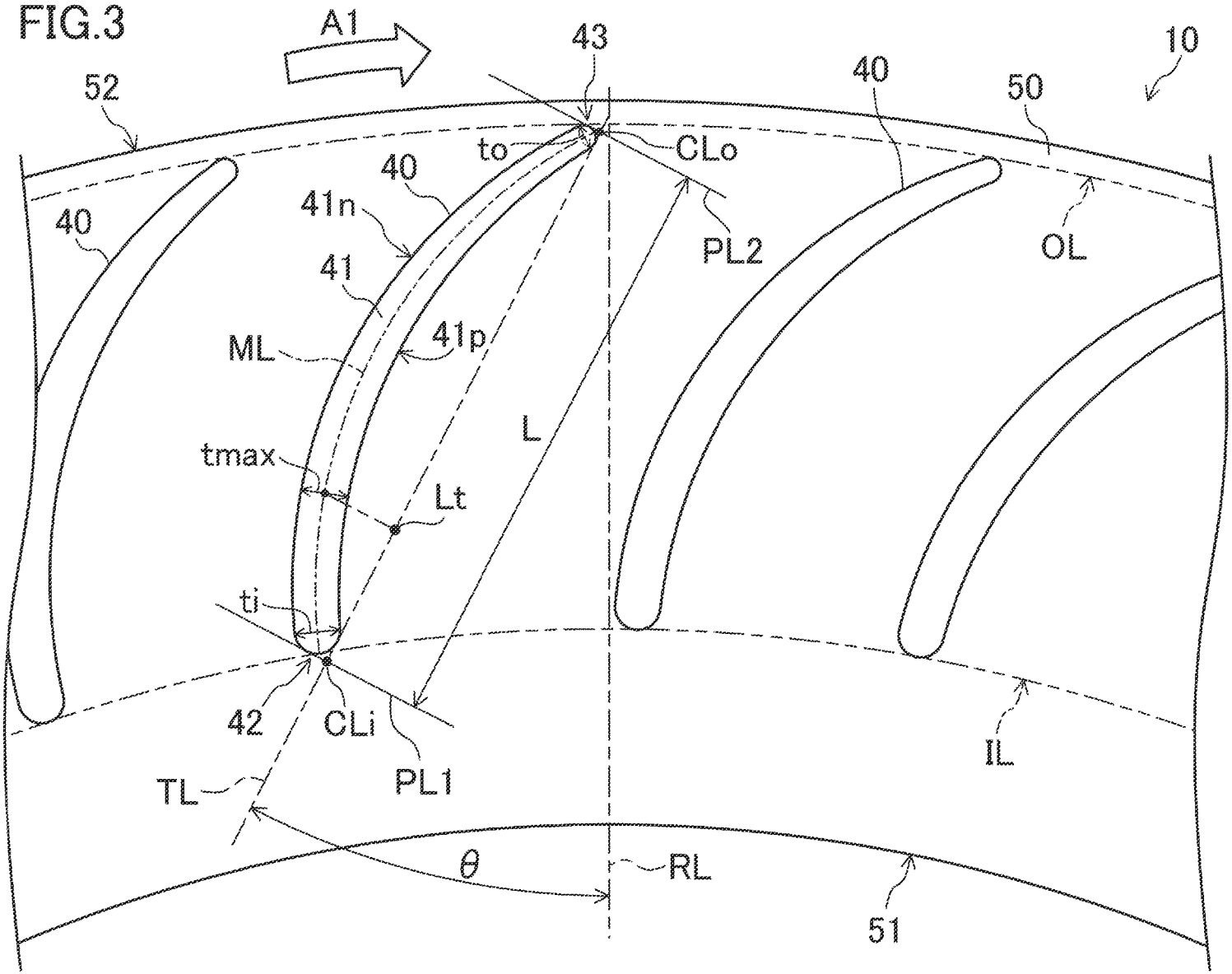
FIG. 3 is a sectional view of blades of the cross flow fan according to the embodiment.

FIG. 3 is a sectional view of blades (40) of the cross flow fan (10) (sectional view in which the blades (40) have been cut by a plane parallel to a supporting plate (50)). As shown in FIG. 3, the ring-shaped supporting plate (50) has an inner circumferential end (51) that is situated on an inner circumferential side of the cross flow fan (10) and an outer circumferential end (52) that is situated on an outer circumferential side of the cross flow fan (10). All the blades (40) that are disposed in one fan block (30) are disposed so as to contact one inscribed circle (IL) and one circumscribed circle (OL), which are concentric with the inner circumferential end (51) and the outer circumferential end (52).

Each blade (40) includes an inner edge (42) disposed on the inner circumferential side of the cross flow fan (10), an outer edge (43) disposed on the outer circumferential side of the cross flow fan (10), and a base part (41) formed between the inner edge (42) and the outer edge (43). Each inner edge (42) is formed so as to have an arc shape that is convex toward the inner circumferential end (51), and contacts the inscribed circle (IL). Each outer edge (43) is formed so as to have an arc shape that is convex toward the outer circumferential end (52), and contacts the circumscribed circle (OL). Each base part (41) has a pressure face (41*p*) that generates positive pressure on a side in the direction of arrow A1 (hereunder referred to as a "fan rotation direction"), and a negative pressure face (41*n*) that generates a negative pressure on a side opposite to the side in the fan rotation direction.

Each blade (40) is a forwardly facing vane that is curved in the fan rotation direction toward the outer circumferential end (52). Specifically, each blade (40) is inclined by an angle θ with respect to a line (RL) orthogonal to the axis (O) of the cross flow fan (10) and extending radially toward the outer circumference from the axis (O). Here, the inclination θ of each blade (40) is defined as an angle between the radially extending line (RL) and a tangential line (TL) that touches the inner edge (42.) and the outer edge (43) of the corresponding blade (40).

The pressure face (41*p*) and the negative pressure face (41*n*) of each blade (40) are curved in an arc toward the side opposite to the fan rotation direction. In other words, even a curvature center of the arc of each pressure face (41*p*) and a curvature center of the arc of each negative pressure face (41*n*) are positioned on the side in the fan rotation direction, A blade chord length L of each blade (40) is a length from an end of the inner edge (42) to an end of the outer edge (43). Specifically, when the tangential line (TL) of each blade (40) is extended toward each of the inner circumferential side and the outer circumferential side, and when a perpendicular line (PL1) that extends upright at the tangential line (TL) and that contacts the inner edge (42) and a perpendicular line (PL2) that extends upright at the tangential line (TL) and that contacts the outer edge (43) are drawn, the length from the perpendicular line (PL1) to the perpendicular line (PL2) is the blade chord length L. In other words, when an intersection of the tangential line (TL) and the perpendicular line (PL1) is an inner edge end (CLi) and when an intersection of the tangential line (TL) and the perpendicular line (PL2) is an outer edge end (CLo), the distance between the inner edge end (CLi) and the outer edge end (CLo) is the blade chord length L.

In each blade (40), the thickness (wall thickness) of the base part (41), that is, the distance between the pressure face (41*p*) and the negative pressure face (41*n*) changes gradually from the inner circumferential side toward the outer circumferential side, and a position where the thickness of the base part (41) becomes a maximum (hereunder referred to as a "maximum thickness position") exists. Here, the maximum thickness of each base part (41) is tmax.

Note that, in the present description, the thickness of each base part (41) is defined as the interval between the pressure face (41*p*) and the negative pressure face (41*n*) in a direction perpendicular to the pressure face (41*p*). As shown in FIG. 3, a maximum thickness position (Lt) is represented by the position of a leg of a perpendicular line drawn to the tangential line (TL) from a portion of a central line (ML) where the thickness becomes the maximum thickness tmax (the central line (ML) being a line obtained by successively joining center points between the pressure face (41*p*) and the negative pressure face (41*n*)).

In the present embodiment, as shown in FIG. 3, the maximum thickness position (Lt) of each base part (41) is set closer to the inner edge (42) (the inner edge end (CLi)) than to the outer edge (43) (the outer edge end (CLo)) on the tangential line (IL). For example, the maximum thickness position (Lt) may be set in a range of 5% to 45% of the blade chord length L from the inner edge end (Cli) on the tangential line (TL). A thickness "ti" of each inner edge (42) is set larger than a thickness "to" of each outer edge (43). For example, ti/to may be ti/to>1.5, or, more desirably, may be ti/to>1.75.

Relationship Between tmax/L and Shaft Power

Figure 4:
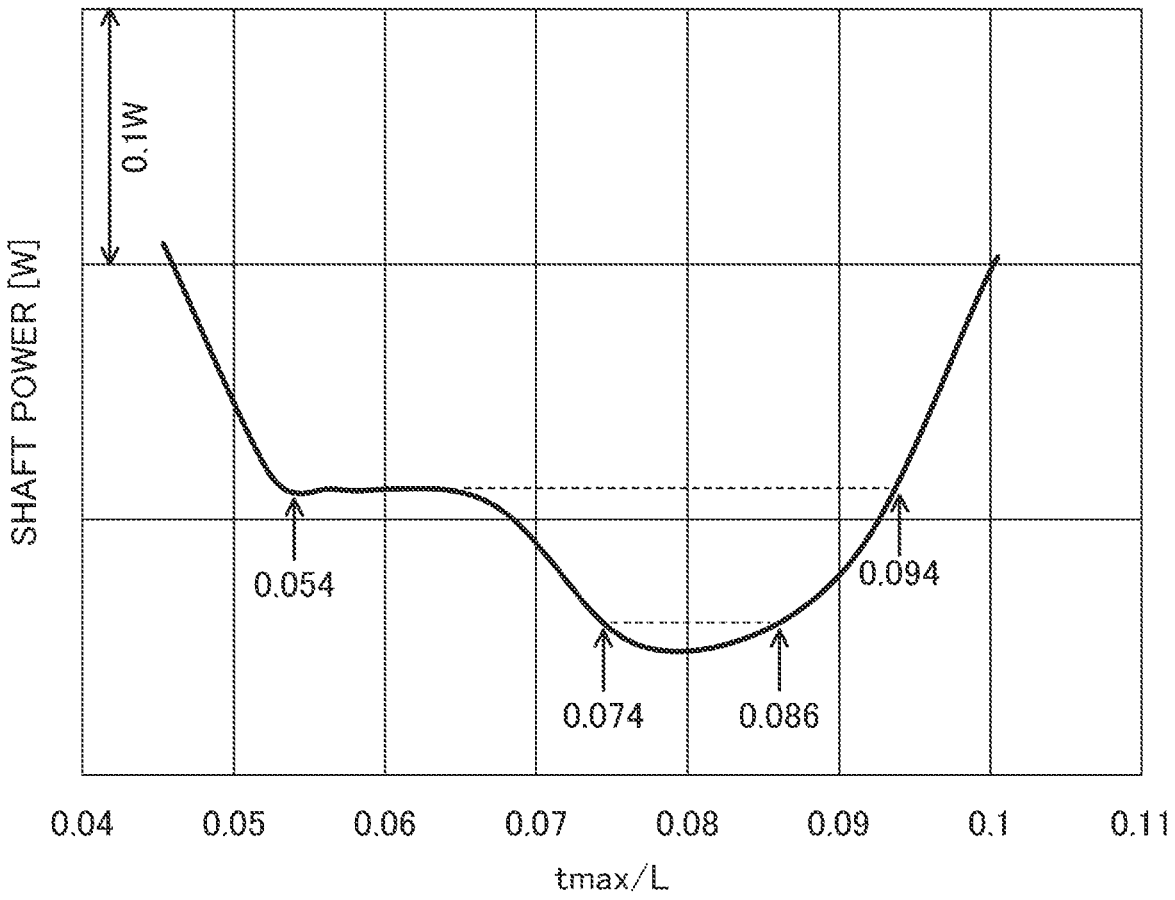
FIG. 4 shows the relationship between shaft power and a ratio of a maximum thickness tmax of a base part to a blade chord length L in the cross flow fan according to the embodiment.

FIG. 4 shows the relationship between shaft power and a ratio tmax/L of the maximum thickness tmax of the base part to the blade chord length L in each blade (40) of the cross flow fan (10) of the present embodiment. Note that the magnitude of one division of the vertical axis in FIG. 4 is 0.1 W.

The relationship shown in FIG. 4 is a perfbrmance evaluation result based on a simulation in a state in which the cross flow fan (10) is installed in the air conditioner indoor unit (1) (wall-mounted indoor unit) of a room air conditioner. Specifically, regarding each ratio tmax/L, the shaft power (power of the rotary shaft (22)) when the number of rotations of the fan is changed and the same air volume is obtained is evaluated. If the air volume is in an air volume range of a general air conditioner indoor unit (for example, 7 to 25 $m^3$/min), a relationship that is the same as that in FIG. 4 can be obtained. Note that an input to a motor that rotates the rotary shaft (22) (power consumption) is a value obtained by dividing the shaft power by the motor efficiency, and that, if the shaft power is reduced, the power consumption of the motor is also reduced.

The blade shape (cross-sectional shape) of the cross flow fan (10) used in the evaluation in FIG. 4 is as described above. If the number of blades (the number of blades (40) that is provided in one fan block (30)) is the number of blades of a cross flow fan of a general air conditioner indoor unit (for example, 31 to 37), a relationship that is the same as that in FIG. 4 is obtained. Although the evaluation in FIG. 4 is based on a simulation in which blade pitches (intervals between adjacent blades (40)) are equal pitches, even if the blade pitches are unequal pitches applied to a cross flow fan of a general air conditioner indoor unit, a relationship that is the same as that in FIG. 4 can be obtained.

As shown in FIG. 4, when tmax/L≤0.094 is satisfied, it is possible to suppress an increase in energy loss caused by an increase in flow velocity as the width of a flow path between blades is increased.

As shown in FIG. 4, when 0.054≤tmax/L is satisfied, it is possible to suppress an increase in energy loss caused by an increase in separation of a flow at each negative pressure face (41*n*) as the maximum thickness tmax of each base part (41) is reduced.

Further, as shown in FIG. 4, when 0.074≤tmax/L≤0.086 is satisfied, the effect of providing a width of a flow path between blades and suppressing an increase in flow velocity and the effect of suppressing separation of a flow at each negative pressure face (41*n*) are balanced, and thus it is possible to further increase energy efficiency, As described above, in each blade (40) of the cross flow fan (10) of the present embodiment, it is desirable that tmax/L≤0.094 be satisfied, more desirable that 0.054≤tmax/L≤0.094 be satisfied, and most desirable that 0.074≤tmax/L≤0.086 be satisfied.

Effects of Embodiments

According to each blade (40) of the cross flow fan (10) of the present embodiment described above, when the ratio tmax/L of the maximum thickness tmax of each base part (41) to the blade chord length L is set to he less than or equal to 0.094, it is possible to provide a width of a flow path between blades and suppress an increase in flow velocity. By setting the maximum thickness position (Lt) of each base part (41) close to the inner edge (42), it is possible to suppress separation of a flow at the negative pressure face (41*n*). Therefore, since loss at each blade (40) can be suppressed, energy efficiency of the cross flow fan (10) is increased.

In each blade (40) of the cross flow fan (10) of the present embodiment, when tmax/L is set to be greater than or equal to 0.054, it is possible to avoid a situation in which, due to the maximum thickness tmax of each base part (41) being made too small, the effect of suppressing separation of a flow at the negative pressure face (41*n*) is reduced.

Further, in each blade (40) of the cross flow fan (10) of the present embodiment, when tmax/L is set to be greater than or equal to 0.074 and less than or equal to 0.086, it is possible to, while sufficiently providing a width of a flow path between blades and further suppressing an increase in flow velocity, obtain the effect of further suppressing separation of a flow at the negative pressure face (41*n*).

In each blade (40) of the cross flow fan (10) of the present embodiment, when the maximum thickness position (Lt) of each base part (41) is set in a range of 5% to 45% of the blade chord length L from the end of the inner edge (42) (inner edge end (CLi) in FIG. 3), it is possible to further suppress separation of a flow at the negative pressure face (41*n*).

In each blade (40) of the cross flow fan (10) of the present embodiment, the thickness "ti" of the inner edge (42) is set larger than the thickness "to" of the outer edge (43). Therefore, since up to the vicinity of the central portion of each blade (40) from the inner edge (42), the thickness of the base part (41) is reduced smoothly, the blade-face curvature of the negative pressure face (41*n*) is not increased. Consequently, even if a flow is about to be separated on the negative pressure face (41*n*), since the flow imm ediately re-adheres to the negative pressure face (41*n*), it is possible to suppress the separation of the flow up to the central portion of each blade (40) from the inner edge (42). On the other hand, since the thickness up to the outer edge (43) from the central portion of each blade (40) is largely reduced, the width of a flow path between blades up to the outer edge (43) from the central portion of each blade (40) can be maintained at a wide width. Therefore, it is possible to reduce blow-out air velocity between the blades by efficiently utilizing the wide width of the flow path between the blades.

According to the cross flow fan (10) of the present embodiment in which a plurality of blades (40) are arranged around the rotary shaft (22), since it is possible to provide a width of a flow path between blades and suppress an increase in flow velocity, it is possible to suppress loss at each blade (40) and to thus increase energy efficiency.

In the cross flow fan (10) of the present embodiment, when the fan diameter D is greater than or equal to 126 mm, it is possible to obtain the following effects. For example, when a large-diameter cross flow fan (10) having a fan diameter that is greater than or equal to 126 mm is to be manufactured by, for example, proportionally enlarging a small-diameter cross flow fan having a fan diameter that is less than 126 mm, the blade chord length L is large compared with that of the small-diameter cross flow fan. However, regarding the maximum thickness tmax of each base part (41), tmax/L≤0.094 is satisfied, as a result of which, compared with the small-diameter cross flow fan, it is possible to considerably reduce the thickness of each blade, and thus the effect of reducing weight and material costs is also increased.

According to the air conditioner indoor unit (1) of the present embodiment including the cross flow fan (10), since energy efficiency of the cross flow fan (10) is increased, it is possible to reduce power consumption.

State of Airflow at Blow-Out Region of Cross Flow Fan

Figure 5:
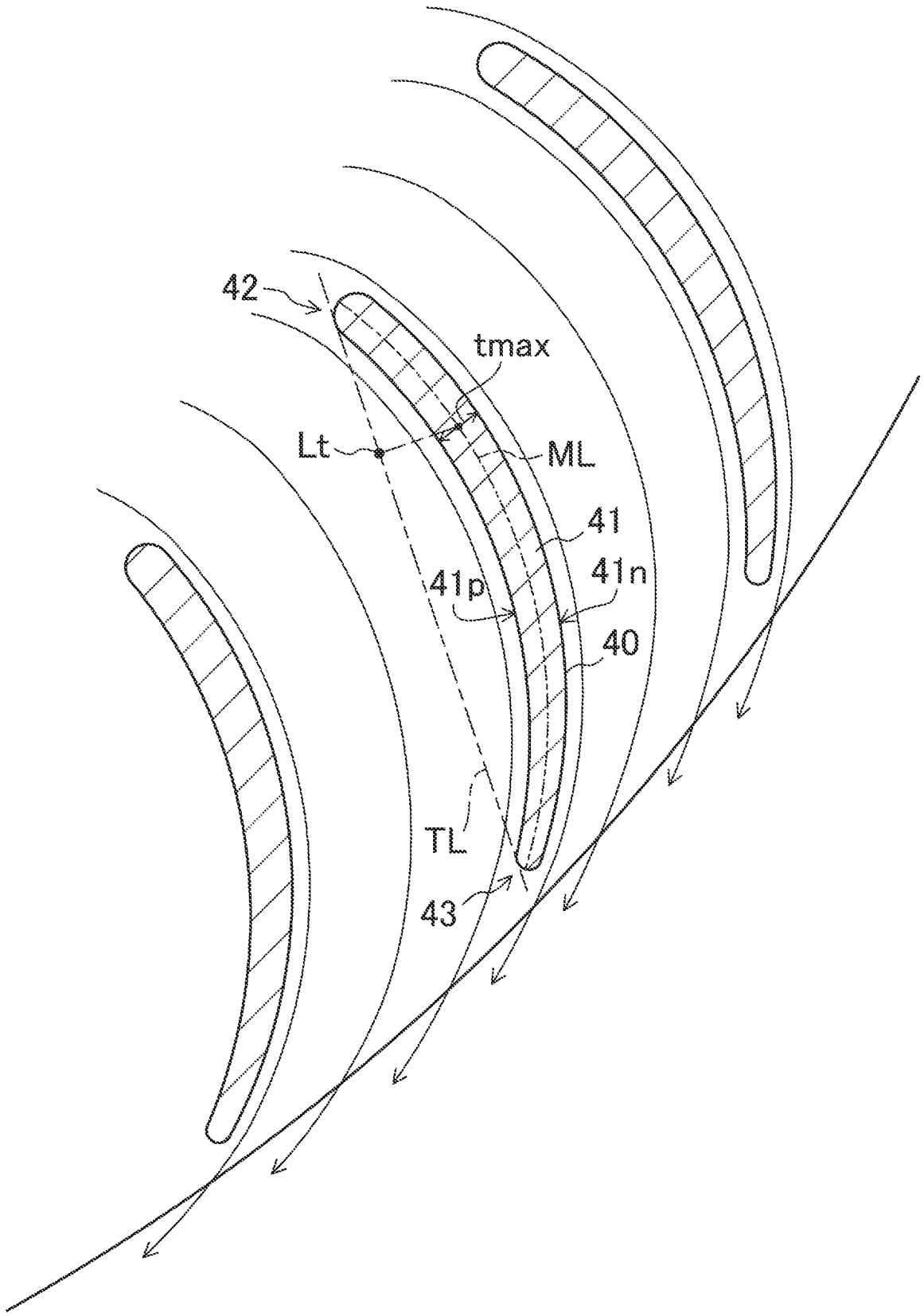
FIG. 5 shows a state of an airflow around the blades of the cross flow fan according to the embodiment.

FIG. 5 shows a state of an airflow around the blades (40) of the cross flow fan (10) of the present embodiment, the blades (40) being positioned in the blow-out region R2 (see FIG. 1).

As shown in FIG. 5, regarding a flow in the vicinity of each blade (40) in the blow-out region R2, when the maximum thickness position (Lt) of each base part (41) exists closer to the inner edge (42) than to the outer edge (43), separation of a flow at the negative pressure face (41*n*) up to the outer edge (43) from the inner edge (42) of each blade (40) is suppressed. Therefore, the flow toward the outer edge (43) from the inner edge (42) is accelerated, and thus turbulence is suppressed. Consequently, generation of, for example, a low-frequency, narrow-band noise is suppressed. Since tmax/L is set to be less than or equal to 0.094, it is possible to provide a width of a flow path between blades and suppress an increase in flow velocity.

Comparative Example 1

Figure 6:
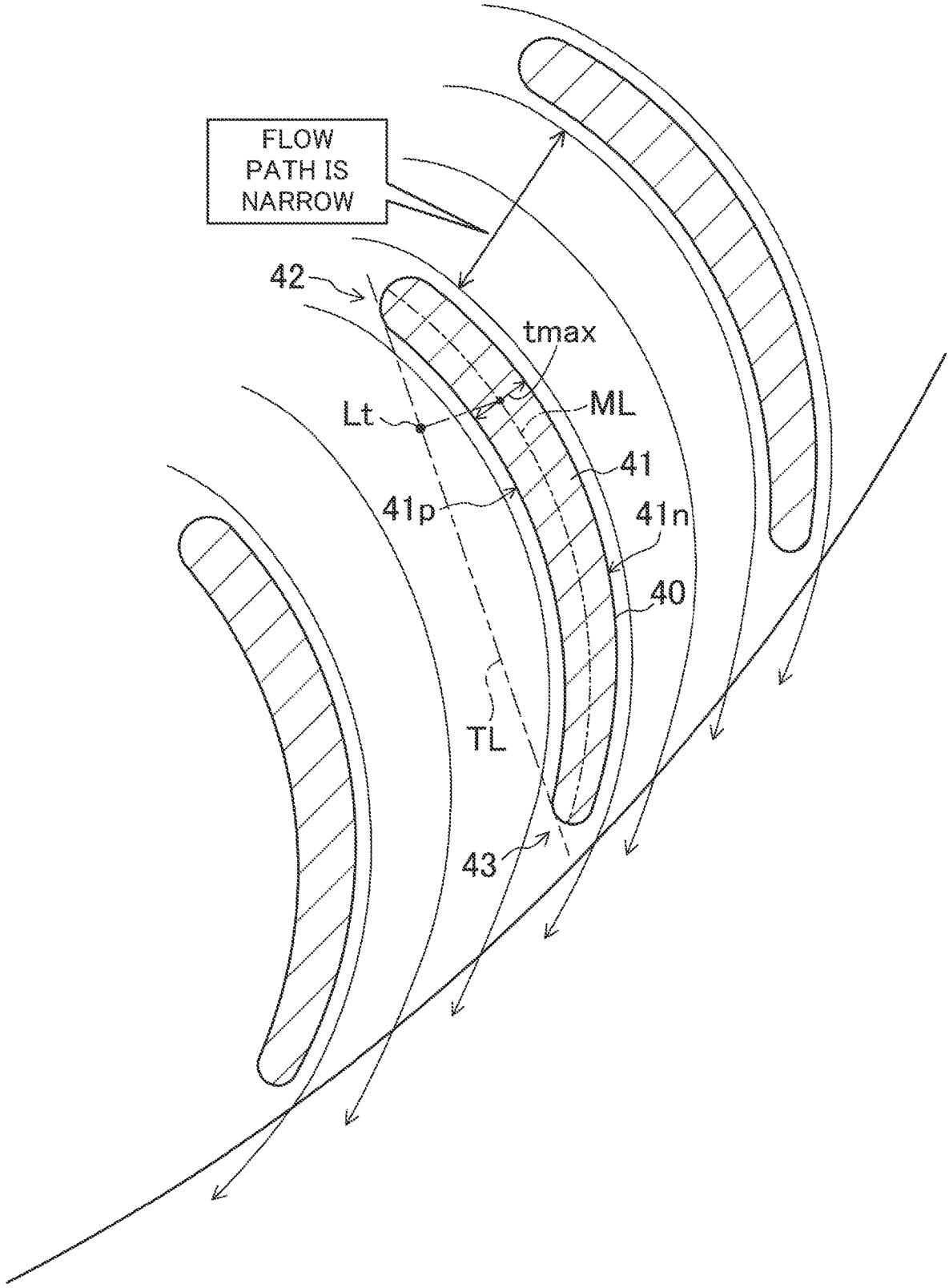
FIG. 6 shows a state of an airflow around blades of a cross flow fan according to Comparative Example 1.

FIG. 6 shows a state of an airflow around blades (40) of a cross flow fan according to Comparative Example 1, in which tmax/L is set to he greater than 0.094. Note that FIG. 6 also shows the state of the airflow in a blow-out region. Even in Comparative Example 1, a maximum thickness position (Lt) of each base part (41) exists closer to an inner edge (42) than to an outer edge (43), and the blade pitch is the same as that in FIG. 5.

As shown in FIG. 6, in Comparative Example 1, separation of a flow at a negative pressure face (41*n*) of each blade (40) is suppressed. However, since tmax/L is set large, the width of a flow path between blades is narrow and thus the flow velocity is increased, as a result of which loss is increased and energy efficiency is reduced.

Comparative Example 2

Figure 7:
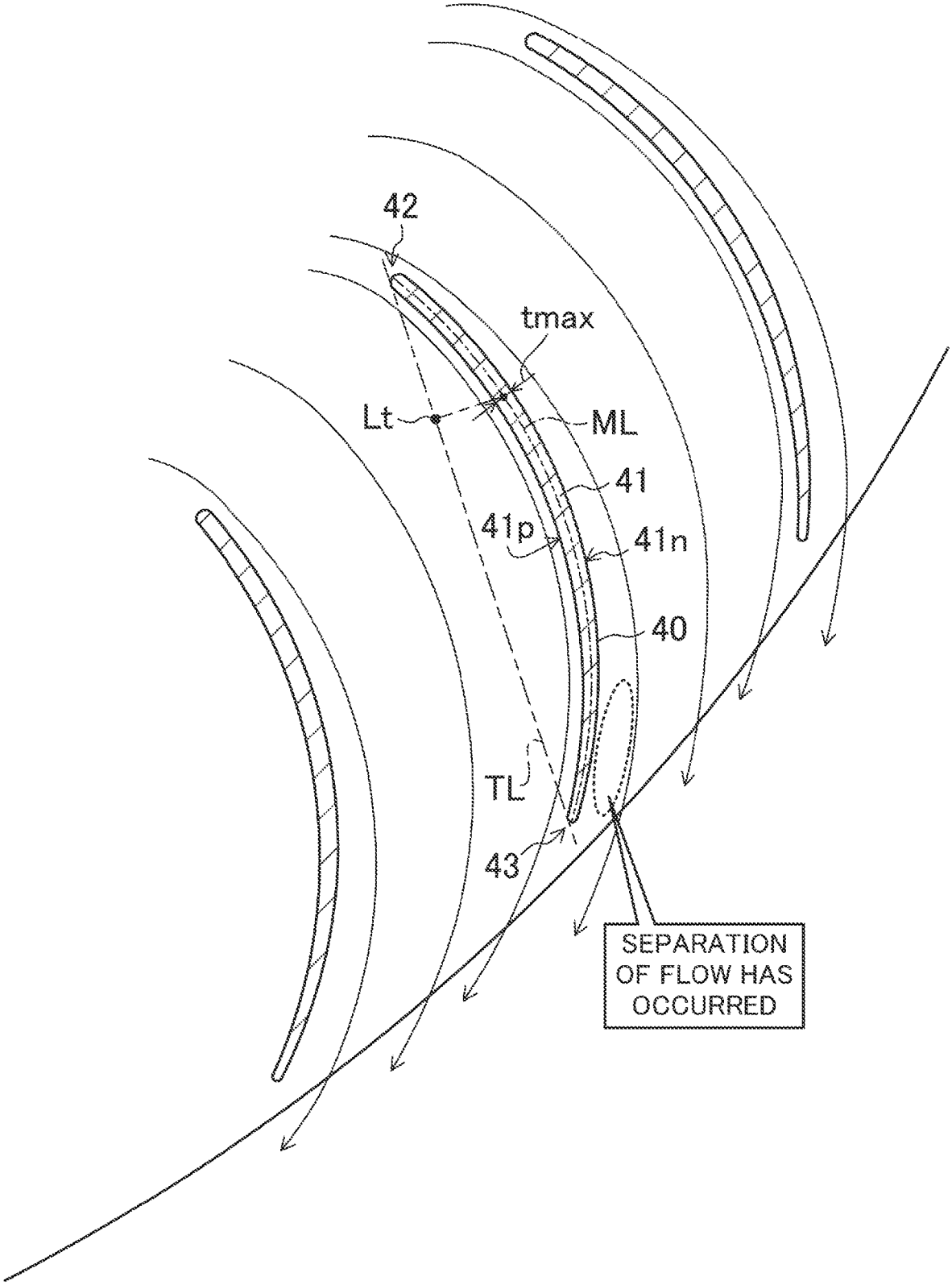
FIG. 7 shows a state of an airflow around blades of a cross flow fan according to Comparative Example 2.

FIG. 7 shows a state of an airflow around blades (40) of a cross flow fan according to Comparative Example 2, in which tmax/L is set to be less than 0.054. Note that FIG. 7 also shows the state of the airflow in a blow-out region. Even in Comparative Example 2, a maximum thickness position (Lt) of each base part (41) exists closer to an inner edge (42) than to an outer edge (43), and the blade pitch is the same as that in FIG. 5.

As shown in FIG. 7, in Comparative Example 2, although the width of a flow path between blades is wide, since tmax/L is set small, separation of a flow at a negative pressure face (41*n*) of each blade (40) becomes noticeable with decreasing distance to the outer edge (43), as a result of which loss is increased and thus energy efficiency is reduced.

Modification 1

Figure 8:
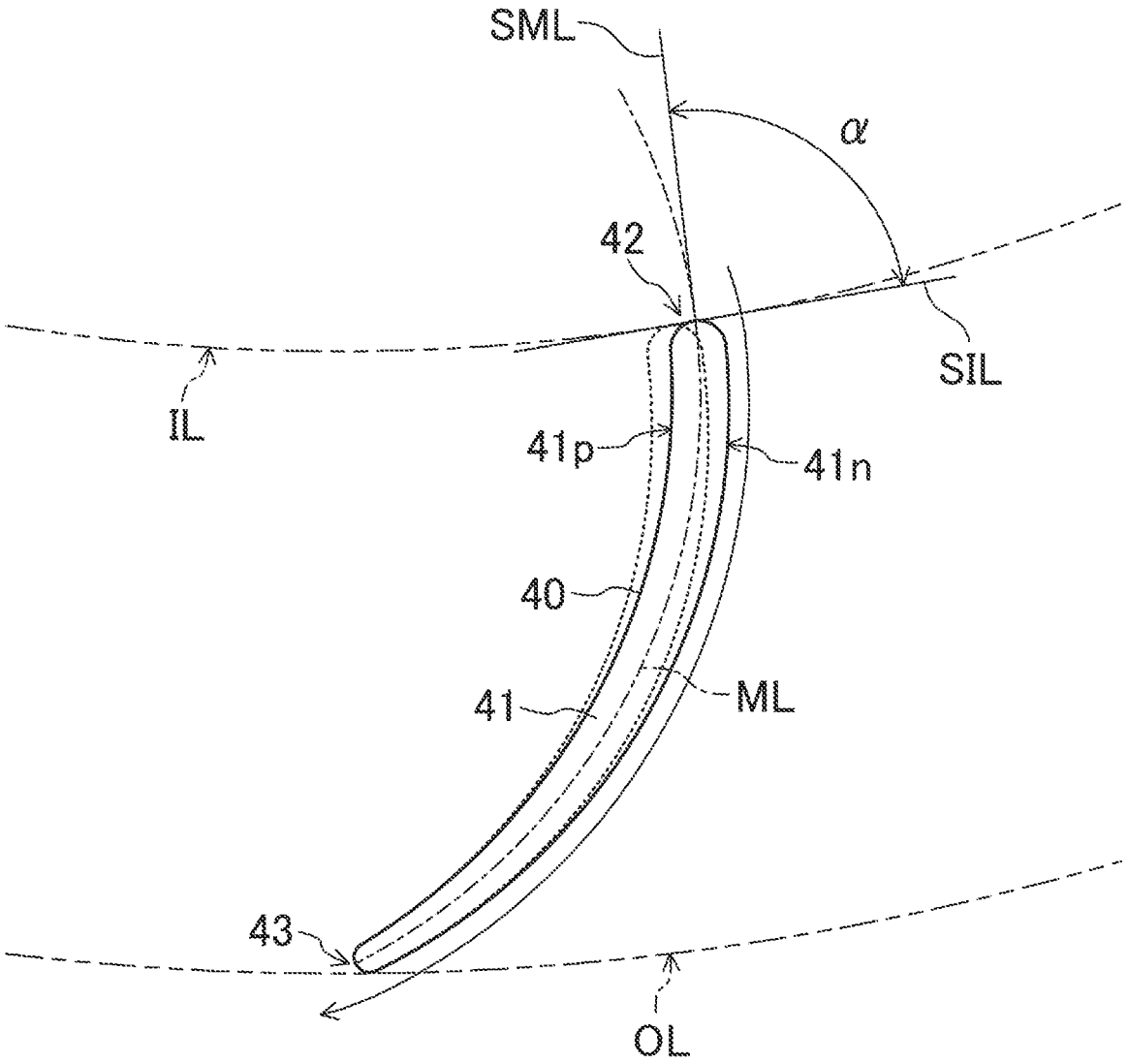
FIG. 8 is a sectional view of a blade of a cross flow fan according to Modification 1.

FIG. 8 is a sectional view of a blade (40) of a cross flow fan (10) according to Modification 1. Note that, in FIG. 8, structural elements that are the same as those of the embodiment shown in FIG. 3 are given the same reference signs. In FIG. 8, the external shape of each blade (40) shown in FIG. 3 is shown by a broken line. FIG. 8 shows by arrows a state of an airflow in the vicinity of a negative pressure face (41*n*) of a blade (40) of the cross flow fan (10) of the present modification, the blade (40) being positioned in the blow-out region R2 (see FIG. 1).

A feature of the blade (40) of the modification shown in FIG. 8 is that an inlet angle α of an inner edge (42) is set to be greater than or equal to 80° and less than or equal to 90°, for example, at 86°. That is, a curve of the blade (40) of the present modification is set smaller than a curve of each blade (40) of the embodiment above (the inlet angle α of the inner edge (42) is, for example, 92.7°). In the present description, the inlet angle α of the inner edge (42) is defined as follows. At an intersection of an inscribed circle (IL) of the inner edge (42) of the blade (40) and a central line (ML) of the blade (40), an angle that is formed by a tangential line (SIL) to the inscribed circle (IL) and a tangential line (SML) to the central line (ML) is the inlet angle α of the inner edge (42).

According to the present modification described above, in addition to the effects that are the same as those of the embodiments above being obtained, since the inlet angle α of the inner edge (42) is set to be greater than or equal to 80° and less than or equal to 90°, the curve of the blade (40) is small, and thus an airflow moves easily along the negative pressure face (41*n*) of the blade (40). Therefore, since it is possible to further suppress separation of a flow at the negative pressure face (41*n*), it is possible to further suppress loss at the blade (40), and to thus further increase energy efficiency of the cross flow fan (10).

Modification 2

Figure 9:
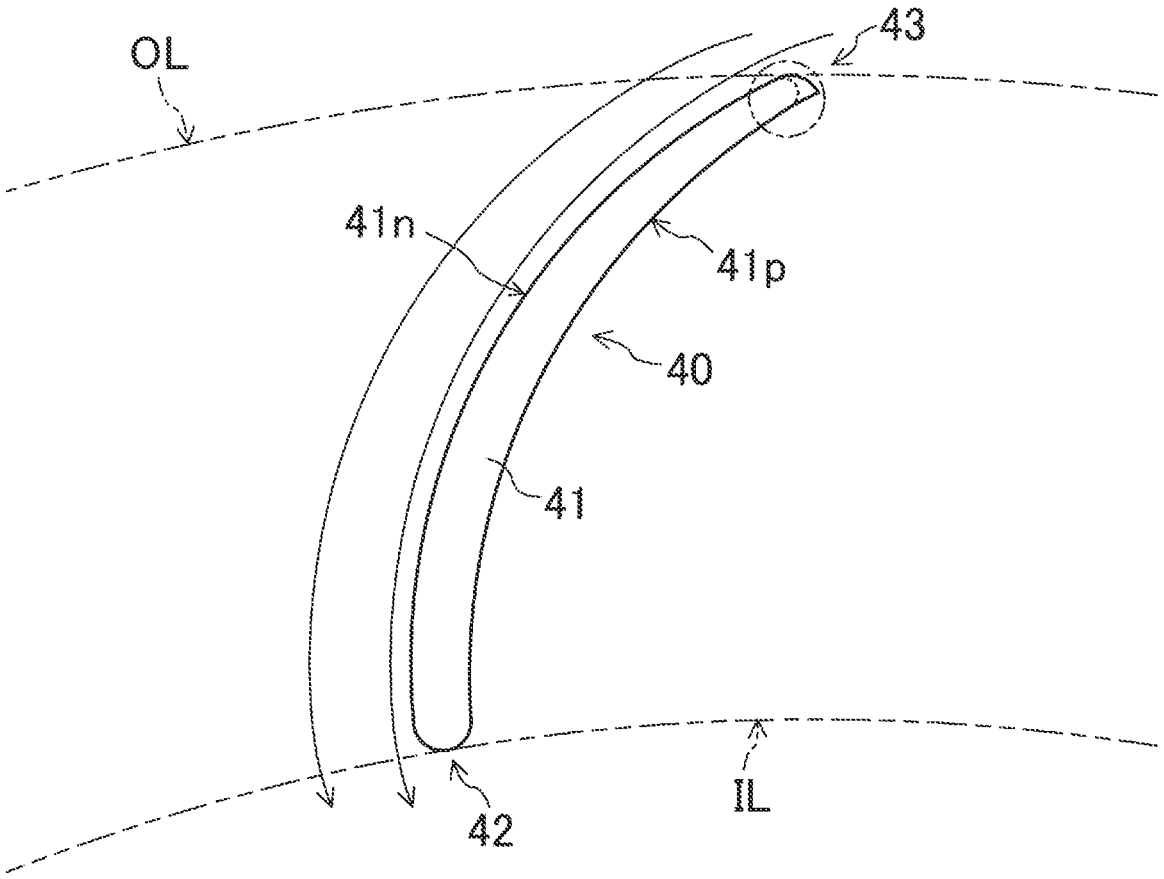
FIG. 9 is a sectional view of a blade of a cross flow fan according to Modification 2.
Figure 10:
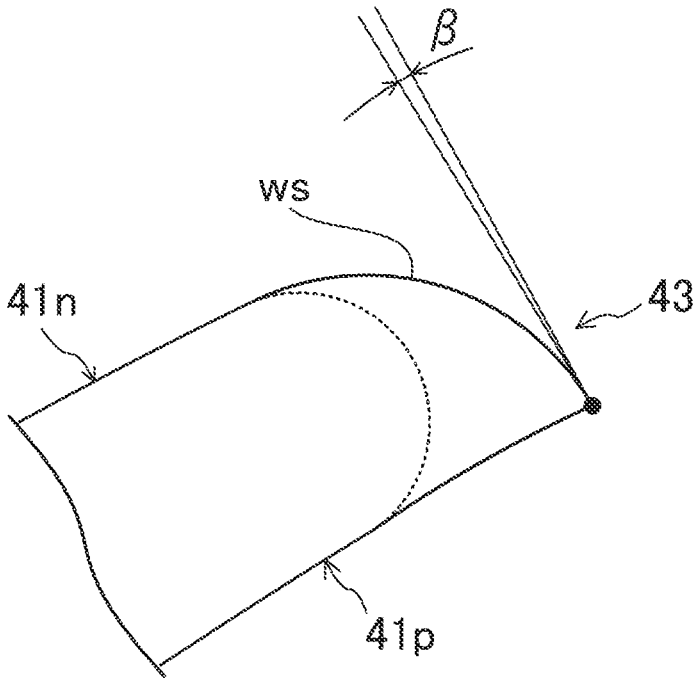
FIG. 10 is a sectional view showing in an enlarged form an outer edge of the blade of the cross flow fan shown in FIG. 9.

FIG. 9 is a sectional view of a blade (40) of a cross flow fan (10) according to Modification 2, and FIG. 10 is a sectional view showing in an enlarged form an outer edge (43) of the blade (40) of the cross flow fan (10) shown in FIG. 9. Note that, in FIGS. 9 and 10, structural elements that are the same as those of the embodiment shown in FIG. 3 are given the same reference signs. In FIGS. 9 and 10, the external shape of each blade (40) shown in FIG. 3 is shown by a broken line. FIGS. 9 and 10 show by arrows a state of an airflow in the vicinity of a negative pressure face (41*n*) of the blade (40) of the cross flow fan (10) of the present modification, the blade (40) being positioned in the suction region R1 (see FIG. 1)

One feature of the blade (40) of the present modification shown in FIGS. 9 and 10 is that a surface of an outer edge (43) on a side of the negative pressure face (41*n*) is a curved surface (ws) that is convex on an outer side, and that the curved surface (ws) is smoothly connected to the negative pressure face (41*n*). That is, a curvature radius of the curved surface (ws) is larger than a curvature radius of the surface of each outer edge (43) of the present embodiment.

Another feature of the blade (40) of the present modification is that the curved surface is connected to a pressure face (41*p*) at an angle that is greater than or equal to 85° and less than or equal to 90°. In other words, at an intersection of the pressure face (41*p*) and the curved surface (ws), when an angle formed by a perpendicular line with respect to the pressure face (41*p*) and a tangential line to the curved surface (ws) is an angle β, the angle β is greater than or equal to 0° and less than or equal to 5°.

According to the present modification described above, in addition to the same effects as those of the embodiments above being obtained, the following effects are obtained. That is, the surface of the outer edge (43) on the side of the negative pressure face (41*n*) is the curved surface (ws) that is convex on the outer side, and the curved surface (ws) is smoothly connected to the negative pressure face (41*n*) and is connected to the pressure face (41*p*) at an angle that is greater than or equal to 85° and less than or equal to 90°. Therefore, an airflow that has reached the vicinity of the outer edge (43) of the blade (40) easily moves along the negative pressure face (41*n*). Therefore, since it is possible to further suppress separation of a flow at the negative pressure face (41*n*), it is possible to further suppress loss at the blade (40), and to thus further increase energy efficiency of the cross flow fan (10).

Note that, in place of or in addition to the structure of the present modification, the following structure may be provided. That is, a surface of an inner edge (42) on a side of the negative pressure face (41*n*) is a curved surface that is convex on an outer side, and the curved surface is smoothly connected to the negative pressure face (41*n*) and is connected to the pressure face (41*p*) at an angle that is greater than or equal to 85° and less than or equal to 90°. Due to this structure, even in the blow-out region R2 (see FIG. 1), it is possible to obtain the same effects as those of the present modification.

Other Embodiments

Although, in the embodiments and the modifications above, a wall-mounted indoor unit has been described as the air conditioner indoor unit (1) including the cross flow fan (10), it is not limited thereto, and the cross flow fan (10) may be used in other types of indoor units, such as a floor-mounted type or a ceiling-mounted type.

Although, in the embodiments and modifications above, the impeller (20) of the cross flow fan (10) is disposed on the downstream side of the indoor heat exchanger (4) in the direction in which air flows, the impeller (20) may be disposed on an upstream side of the indoor heat exchanger (4) instead.

Although the embodiments and modifications have been described above, it will be understood that various changes in form and detail can be made without departing from the spirit and scope of the claims. The embodiments and modifications above may he combined or replaced as appropriate as long as the object functions of the present disclosure are not impaired.

As described above, the present disclosure is useful for a cross flow fan blade, a cross flow fan, and an air conditioner indoor unit.

The invention claimed is:

1. A cross flow fan blade comprising:

an inner edge disposed on an inner circumferential side of a cross flow fan;

an outer edge disposed on an outer circumferential side of the cross flow fan; and a base part formed between the inner edge and the outer edge, the base part having a pressure face and a negative pressure face, a thickness of the inner edge being larger than 1.5 times a thickness of the outer edge, an interval between the pressure face and the negative pressure face in a direction perpendicular to the pressure face is a thickness of the base part, and a maximum thickness position of the base part being closer to the inner edge than to the outer edge, and when a blade chord length is L and a maximum thickness of the base part is tmax, $tmax/L \leq 0.094$, and a range of $tmax/L \leq 0.08$ is excluded.

2. The cross flow fan blade according to claim 1, wherein the maximum thickness position of the base part is in a range of 5% to 45% of the blade chord length from an end of the inner edge.

3. The cross flow fan blade according to claim 2, wherein an inlet angle of the inner edge is greater than or equal to 80° and less than or equal to 90°.

4. The cross flow fan blade according to claim 2, wherein a surface on a side of the negative pressure face of at least one of the inner edge and to the outer edge is a curved surface that is convex on an outer side, and the curved surface is smoothly connected to the negative pressure face and is connected to the pressure face at an angle that is greater than or equal to 85° and less than or equal to 90°.

5. A cross flow fan including a plurality of the blades according to claim 2, the plurality of blades being arranged around a rotary shaft.

6. The cross flow fan blade according to claim 1, wherein an inlet angle of the inner edge is greater than or equal to 80° and less than or equal to 90°.

7. The cross flow fan blade according to claim 6, wherein a surface on a side of the negative pressure face of at least one of the inner edge and the outer edge is a curved surface that is convex on an outer side, and the curved surface is smoothly connected to the negative pressure face and is connected to the pressure face at an angle that is greater than or equal to 85° and less than or equal to 90°.

8. A cross flow fan including a plurality of the blades according to claim 6, the plurality of blades being arranged around a rotary shaft.

9. The cross flow fan blade according to claim 1, wherein a surface on a side of the negative pressure face of at least one of the inner edge and the outer edge is a curved surface that is convex on an outer side, and the curved surface is smoothly connected to the negative pressure face and is connected to the pressure face at an angle that is greater than or equal to 85° and less than or equal to 90°.

10. A cross flow fan including a plurality of the blades according to claim 6, the plurality of blades being arranged around a rotary shaft.

11. A cross flow fan including a plurality of the blades according to claim 1, the plurality of blades being arranged around a rotary shaft.

12. The cross flow fan according to claim 11, wherein a fan diameter is greater than or equal to 126 mm.

13. An air conditioner indoor unit including the cross flow fan according to claim 12.

14. An air conditioner indoor unit including the cross flow fan according to claim 11.

* * * * *